United States Patent [19]

Wyner et al.

[11] Patent Number: 4,647,819

[45] Date of Patent: Mar. 3, 1987

[54] METAL VAPOR LAMP STARTING AND OPERATING APPARATUS

[75] Inventors: Elliot F. Wyner, Peabody; John A. Scholz, Danvers, both of Mass.

[73] Assignee: GTE Products Corporation, Stamford, Conn.

[21] Appl. No.: 691,814

[22] Filed: Jan. 16, 1985

[51] Int. Cl.[4] ..... H05B 37/00; H05B 39/00; H05B 41/14

[52] U.S. Cl. ..... 315/241 R; 315/243; 315/289; 315/107; 315/242

[58] Field of Search ..... 315/240, 241, 242, 243, 315/289, 290, 306, 307, 101, 106, 107

[56] References Cited

U.S. PATENT DOCUMENTS 3,364,386 1/1968 Segawa et al. ..... 315/289 X
4,360,762 11/1982 Yamamoto et al. ..... 315/101
4,399,390 8/1983 Oshita et al. ..... 315/101
4,442,380 4/1984 Adachi ..... 315/241 R
4,513,227 4/1985 Labadini et al. ..... 315/101

*Primary Examiner*—Saxfield Chatmon
*Attorney, Agent, or Firm*—Thomas H. Buffton; Jose W. Jimenez

[57] ABSTRACT

A low wattage metal vapor discharge lamp starting and operating apparatus includes an inductive ballast connected to one of a pair of terminals connectable to a low voltage source, a metal vapor discharge lamp coupled to the ballast and to the other one of the pair of lamp terminals and a non-linear dielectric element shunting the discharge lamp with the ballast and non-linear dielectric element providing a potential within about 600 usec of current reversal of the source voltage in an amount sufficient to initiate operation of the discharge lamp.

7 Claims, 4 Drawing Figures

METAL VAPOR LAMP STARTING AND OPERATING APPARATUS

CROSS-REFERENCE TO RELATED APPLICATIONS

A co-pending application entitled "Discharge Lamp Operating Apparatus and Method" filed Aug. 10, 1984 and bearing U.S. Ser. No. 639,608 relates to a process and apparatus for starting and operating discharge lamps of increased light output from a given voltage source. Also, a co-pending application entitled "Metal Vapor Lamp Having Low Starting Voltage" bearing U.S. Ser. No. 643,948 relates to a metal vapor lamp including a starting aid and providing enhanced light output from a lamp operated from a voltage source having a given output capability.

TECHNICAL FIELD

This invention relates to metal vapor lamp starting and operating apparatus and more particularly to apparatus for starting and operating metal vapor lamps by providing a pulse potential within about 600-usec of current extinction from an alternating source potential.

BACKGROUND ART

Generally, discharge lamps operable from 50 or 60 hertz alternating current voltage sources emit radiation in the visible region of the spectrum. These discharge lamps may be in the form of high intensity discharge metal vapor lamps such as mercury vapor, metal halide and high pressure sodium lamps for example. Normally, the discharge lamp has a negative volt-ampere characteristic and the current of such a plasma will tend to continually increase in magnitude if not restrained by a current limiter or ballast in series connection with the lamp.

Typically, metal vapor discharge lamps employed with a series connected inductive ballast are selected to have a voltage operational value substantially equal to about 50% of the rms value of a voltage source. Thus, a lamp operable from a 120-volt AC voltage source would have a design center voltage of about 52-volts and this voltage could rise as much as 25-volts over the life of the discharge lamp. However, this increase in operational voltage will undesirably reach a level whereat the voltage source no longer provides a potential sufficient to sustain operation of the lamp and the lamp is undesirably extinguished.

One known technique employed to increase this potential available to the discharge lamp is a step-up transformer and a fixed capacitor. In such apparatus, the source potential is stepped-up to a higher value whereby the level of potential whereat the lamp is extinguished is raised to a higher level than was previously available. Unfortunately, transformers are expensive, cumbersome and heavy which adds a multitude of undesirable features to the apparatus.

Another known apparatus for improving the operation of a ballast and discharge lamp is suggested in U.S. Pat. No. 3,996,495 issued to Herman on Dec. 7, 1976 and bearing the title "High Efficiency Ballast System For Electric Discharge Lamps". Therein, a non-linear capacitor is connected to a conventional high resistance transformer and allegedly improves a lamp current crest factor. Thus, lamp efficiency is reportedly improved because of an improved lamp current crest factor. In this manner, lamp current can be reduced without loss of light output. However, starting and maintaining ignition of increased wattage lamps remains a problem.

Another known apparatus suggesting improved starting and operating of fluorescent lamps is proposed in U.S. Pat. No. 4,079,292 issued to Kaneda on Mar. 14, 1978. Therein, an oscillation booster circuit is utilized to provide reignition energy to a discharge lamp in each half cycle of an AC power source. Thus, a relatively small inductor ballast may be utilized in conjunction with a relatively high voltage discharge lamp. However, auxiliary booster oscillator circuitry as well as the switching circuitry associated therewith are obvious disadvantages in so far as apparatus cost are concerned.

Additionally, United Kingdom Pat. No. 2,066,801 A published July 15, 1981 and issued to TDK Electronics Company, Ltd. suggests a non-linear dielectric element, the composition thereof, and a circuit utilizing the device with a lamp and a relatively complex preheating circuit for starting a lamp. Primarily, fabrication of this non-linear dielectric element is discussed and claimed.

Still another apparatus is suggested in an application bearing U.S. Ser. No. 639,608 entitled "Discharge Lamp Operating Apparatus And Method" filed Aug. 10, 1984 and assigned to the Assignee of the present application. Therein, a discharge lamp starting and operating apparatus includes a discharge lamp having an operating voltage not less than about 75% of the rms value of a voltage source. Therein, a fluorescent lamp shunted by a non-linear dielectric element and coupled by an inductive ballast to a pair of terminals connectable to the voltage source.

OBJECTS AND SUMMARY OF THE INVENTION

An object of the present invention is to provide an enhanced apparatus and method for operating electric discharge lamps. Another object of the invention is to improve the efficiency of a discharge lamp system operable from a given service voltage source. Still another object of the invention is to increase the percentage of the supply voltage available to the discharge lamp. A further object of the invention is to increase the operational potential of the discharge lamp.

These and other objects, advantages and capabilities are achieved in one aspect of the invention by a metal vapor discharge lamp starting and operating apparatus having a pair of terminals connectable to a low voltage source, an inductive ballast connected to one of the pair of terminals, a metal vapor discharge lamp connected to the ballast and to the other one of the pair of terminals and a non-linear dielectric element shunting the discharge lamp and in conjunction with the ballast providing a pulse potential within about 600 usec of current reversal of the potential source in an amount sufficient to increase the operational voltage of the discharge lamp.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
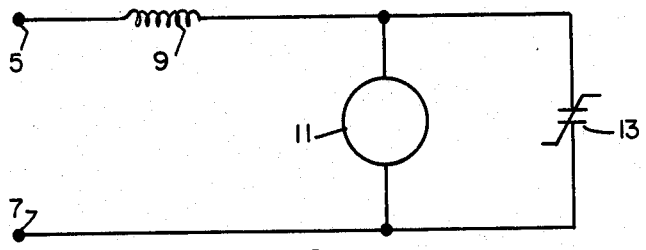
FIG. 1 is a schematic illustration of a preferred form of metal vapor discharge lamp starting and operating apparatus.

Referring to the drawings, a low wattage metal vapor discharge lamp starting and operating apparatus is illustrated in FIG. 1. Therein, a pair of terminals, 5 and 7 respectively, are formed for connection to a low-voltage source such as a 120-volt AC source for example. An inductive ballast 9 is connected to one 5 of the pair of terminals 5 and 7. Also, a metal vapor discharge lamp 11, which may be in the form of a mercury vapor discharge lamp, a metal halide discharge lamp or a high pressure sodium lamp for example, is connected to the inductive ballast 9 and to the other one 7 of the pair of terminals 5 and 7. Shunted across the metal vapor discharge lamp 11 is a non-linear dielectric element 13 in the form of a non-linear capacitor for example.

As to operation, it has been previously mentioned that the usual apparatus associated with the starting and operating of metal arc type discharge lamps includes a discharge lamp designed for operation at about 50% of the rms line voltage available. Also, it has been mentioned that the lamp voltage tends to undesirably increase over the life period of the lamp such that this increase in lamp voltage reaches a value which is greater than the potential available from the line or voltage source whereupon the lamp is extinguished.

It should be further noted that the voltage necessary for starting conduction and for continuing or maintaining conduction of a metal vapor discharge lamp is dependent upon the plasma of the particular lamp. Decay of the plasma conductivity occurs during the non-conductive period of the lamp. Thus, the time period during which the lamp is non-conductive affects the potential and time necessary to make the discharge lamp again conductive.

Figure 2:
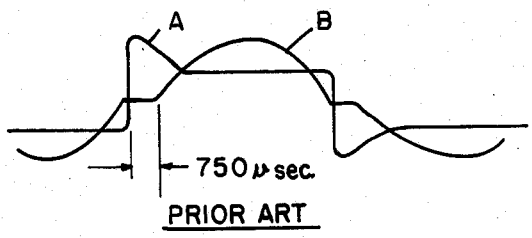
FIG. 2 is a graphic illustration of the current and voltage attainable with the apparatus of FIG. 1 without the inclusion of a non-linear dielectric element.

Referring to FIG. 2 of the drawings, therein is illustrated the voltage (Curve A) and current (Curve B) waveforms of a low wattage metal vapor discharge lamp starting and operating apparatus of the prior art. More specifically, the apparatus includes an inductive ballast and metal vapor discharge lamp but does not include a non-linear dielectric element. Accordingly, it can be seen that it takes about 750 usec after polarity reversal before current flows in the discharge lamp in accordance with the potential available for effecting conductivity of the discharge lamp.

Figure 3:
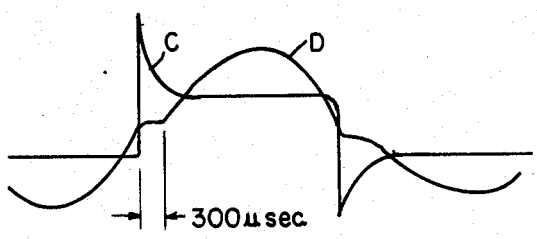
FIG. 3 is a graphic illustration of the current and voltage attainable with the apparatus of FIG. 1.

In contrast thereof, FIG. 3 illustrates the results of the low wattage metal vapor discharge lamp starting and operating apparatus of the invention. Utilizing the same discharge lamp, a 70-watt high pressure sodium lamp, in both instances but including a non-linear dielectric element 13 shunting the discharge lamp, the illustrated voltage (Curve C) and current (Curve D) waveform are obtained. As can readily be seen, the voltage (Curve C) has been enhanced and importantly, current conduction (Curve D) is effected within a period of about 300-usec after having reversed polarity. Thus, lamp conduction is effected in about 50% of the time when a non-linear dielectric element is employed as compared to apparatus which does not include the non-linear dielectric element.

Figure 4:
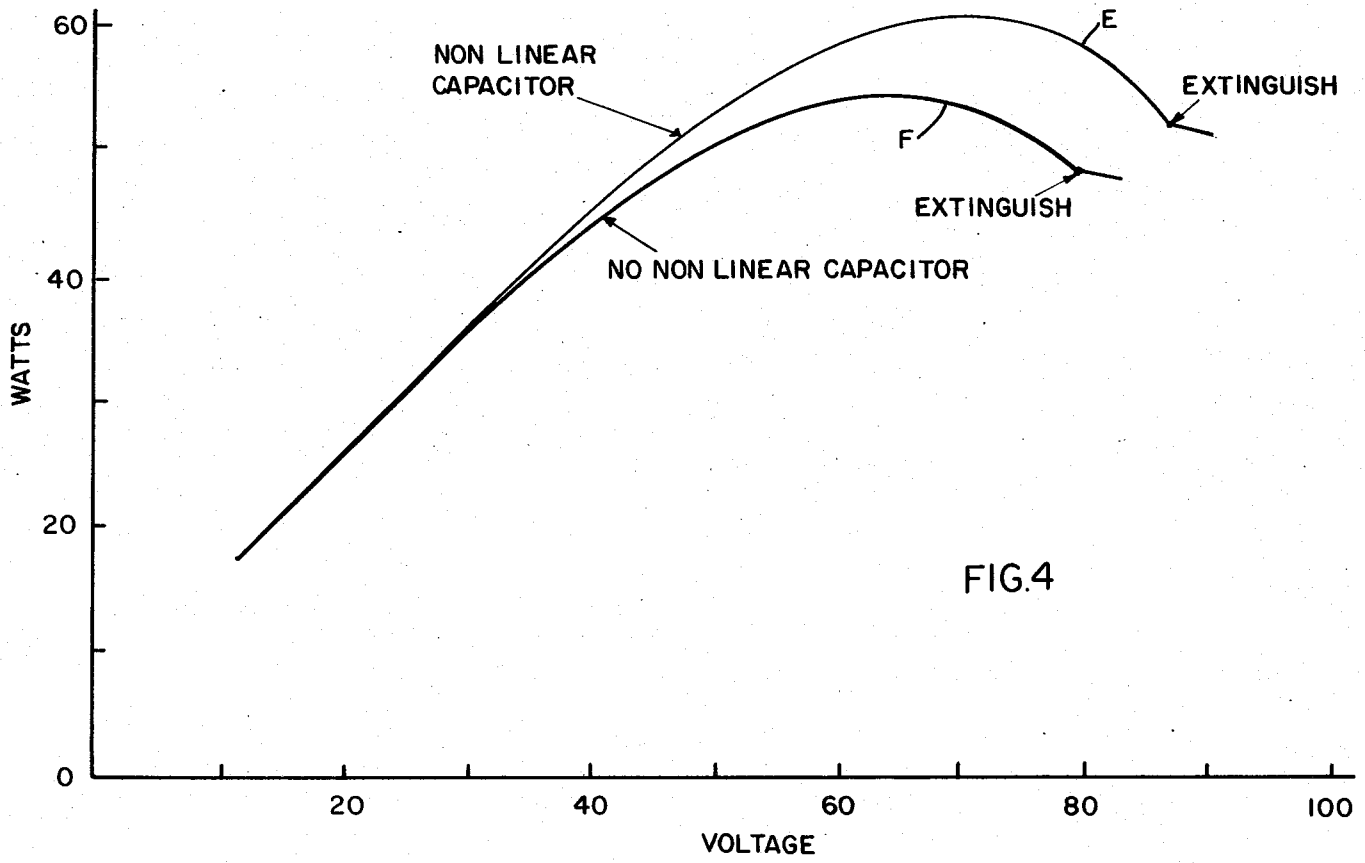
FIG. 4 is a chart comparing the lamp voltages attainable with and without the non-linear dielectric element of FIG. 1.

Also, the illustration of FIG. 4 compares the lamp voltage of apparatus which includes a non-linear dielectric element (Curve E) with apparatus which does not include a non-linear dielectric element (Curve F). As can readily be seen, the lamp voltage whereat the lamp is extinguished is greater for the apparatus employing a non-linear dielectric element (Curve E) than the apparatus wherein the non-linear dielectric element is not employed (Curve F). Moreover, the improved apparatus has a lamp extinguishing voltage which is about 8.0-volts greater than the apparatus which does not have a non-linear dielectric element.

Specifically, the above-mentioned test results were provided by apparatus operable from a source voltage in the range of about 108 to 132-volts AC and employed a 70-watt high pressure sodium lamp having a fill gas of Xenon at a pressure of about 30 Torr. The inductive ballast had an inductance of about 235 millihenries and an impedance of about 88.7-ohms at a voltage of about 94.0-volts and a current of about 1.06 amperes. Also, the non-linear dielectric element was a TDK manufactured element having a diameter of about 12 mm and a thickness of about 0.5 mm.

Accordingly, it was found that the improved apparatus has an extinguishing voltage about 8.0-volts higher than the extinguishing voltage of prior known structures. Also, the increased voltage and a substantially constant wattage permits a reduction in current by about 13% and a decrease of about 4.6% in the voltage applied to the inductive ballast. Thus, the volt-ampere requirements of the inductive ballast were reduced by about 17% which permits a reduction in size, weight and volume of the inductive ballast.

Accordingly, the addition of a non-linear dielectric element reduces the lamp starting period after each polarity reversal of current which, in turn, permits a reduction in the size of the inductive ballast required and increases the lamp voltage available prior to extinguishment of the discharge lamp. Thus, the discharge lamp starts sooner, stays on longer and is permitted to develop a greater potential before lamp extinguishment occurs.

While there has been shown and described what is at present considered the preferred embodiments of the invention, it will be obvious to those skilled in the art that various changes and modifications may be made therein without departing from the invention as defined by the appended claims.

We claim:

1. Low wattage metal vapor discharge lamp starting and operating apparatus comprising:
   - a pair of terminals formed for connection to a low voltage AC potential source;
   - an inductive ballast connected to one of said pair of terminals;
   - a low wattage metal vapor discharge lamp connected to said inductive ballast and to the other one of said pair of terminals; and
   - a non-linear dielectric element shunting said metal vapor discharge lamp and in conjunction with said inductive ballast providing a pulse potential within about 600-usec of current reversal of said potential source in an amount sufficient to provide an increase in operational lamp voltage.

2. The low wattage metal vapor discharge lamp starting and operating apparatus of claim 1 wherein said low voltage AC potential source is in the range of about 108 to 132-volts and said operational lamp voltage of said low wattage metal vapor discharge lamp is increased by about 8.0-volts.

3. The low wattage metal vapor discharge lamp starting and operating apparatus of claim 1 wherein said inductive ballast has an inductance of about 235 millihenries.

4. The low wattage metal vapor discharge lamp starting and operating apparatus of claim 1 wherein said non-linear dielectric element has a diameter of about 2.0 mm and a thickness of about 0.5 mm.

5. The low wattage metal vapor discharge lamp starting and operating apparatus of claim 1 wherein said discharge lamp has an operating wattage of less than about 100-watts.

6. The low wattage metal vapor discharge lamp starting and operating apparatus of claim 1 wherein said inductive ballast has an inductance of about 235 millihenries, said non-linear dielectric element has a diameter of about 12.0 mm and a thickness of about 0.5 mm, said discharge lamp has an operating wattage of about 70-watts and said AC voltage source has a potential in the range of about 108 to 132-volts.

7. The low wattage metal vapor discharge lamp starting and operating apparatus of claim 1 wherein said discharge lamp is selected from the group consisting of high pressure sodium, mercury vapor and metal halide discharge lamps.

* * * * *